US008201806B2

(12) United States Patent
Liou

(10) Patent No.: US 8,201,806 B2
(45) Date of Patent: Jun. 19, 2012

(54) TOOL WITH WORKING AND POSITIONING DEVICES

(76) Inventor: Mou-Tang Liou, Ta Li (TW)

( * ) Notice: Subject to any disclaimer, the term of this patent is extended or adjusted under 35 U.S.C. 154(b) by 747 days.

(21) Appl. No.: 12/371,648

(22) Filed: Feb. 16, 2009

(65) Prior Publication Data

US 2010/0207081 A1 Aug. 19, 2010

(51) Int. Cl.
*B66F 15/00* (2006.01)

(52) U.S. Cl. ..... 254/27; 254/26 R

(58) Field of Classification Search ..... 254/129, 254/21, 25, 28, 26 R, 26 E, 18; 7/166, 143
See application file for complete search history.

(56) References Cited

U.S. PATENT DOCUMENTS 2,643,854 A * 6/1953 Johnson ..... 254/26 E
2,804,109 A * 8/1957 Fatica ..... 30/308.1
5,280,738 A * 1/1994 Liou ..... 81/20
5,871,204 A * 2/1999 Spirer ..... 254/26 R
7,025,331 B2 * 4/2006 Whelan ..... 254/25
7,278,626 B1 * 10/2007 Chang ..... 254/25
2010/0207081 A1 * 8/2010 Liou ..... 254/129
2010/0314593 A1 * 12/2010 Fan ..... 254/25

* cited by examiner

*Primary Examiner* — Lee D Wilson
(74) *Attorney, Agent, or Firm* — Alan Kamrath; Kamrath IP Lawfirm, PA

(57) ABSTRACT

A tool adapted for prying includes a handle including a pivotal end and a grip end, with the pivotal end having a through-hole. A working device has first and second ends. The first end of the working device is pivotally connected to the pivotal end of the handle and includes a positioned hole formed transversely and a cavity formed longitudinally and communicating with the positioned hole, with the positioned hole corresponding to the through-hole. A positioning device is disposed at the through-hole, the positioned hole and the cavity and moveable between a fixing position and an adjusting position.

16 Claims, 16 Drawing Sheets

TOOL WITH WORKING AND POSITIONING DEVICES

BACKGROUND OF THE INVENTION

1. Field of the Invention

The present invention relates to a tool having a working device which includes prongs for extracting an element to be pried and a positioning device adapted for positioning the prying device at various angles with respect to a handle of the tool.

2. Description of the Related Art

A tool, generally known as a crowbar, includes a straight bar and a working end slightly bent with respect to the bar and forked. In operation, the working end is engaged with an element to be extracted, and the straight bar is used as a lever to pivot about a fulcrum.

However, the working end is usually fixed to the straight bar and cannot be adjustably connected to the straight bar at various angles. It's not convenient to be used in various slopes. The present invention is, therefore, intended to obviate or at least alleviate the problems encountered in the prior art.

SUMMARY OF THE INVENTION

According to the present invention, a tool includes a handle and a prying device pivotally connected to the handle and positionable at various pivoting positions with respect to the handle. The prying device is engagable with an object to be pried, and the handle is utilized as a lever to extract the object efficiently. The tool also includes a hammering portion.

It is an aspect of the present invention that the toot is usable for prying an object and used as a hammer.

It is another aspect of the present invention that the tool has a simple structure and is manufactured cost-effectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DETAILED DESCRIPTION OF THE PREFERRED EMBODIMENTS

Figure 1:
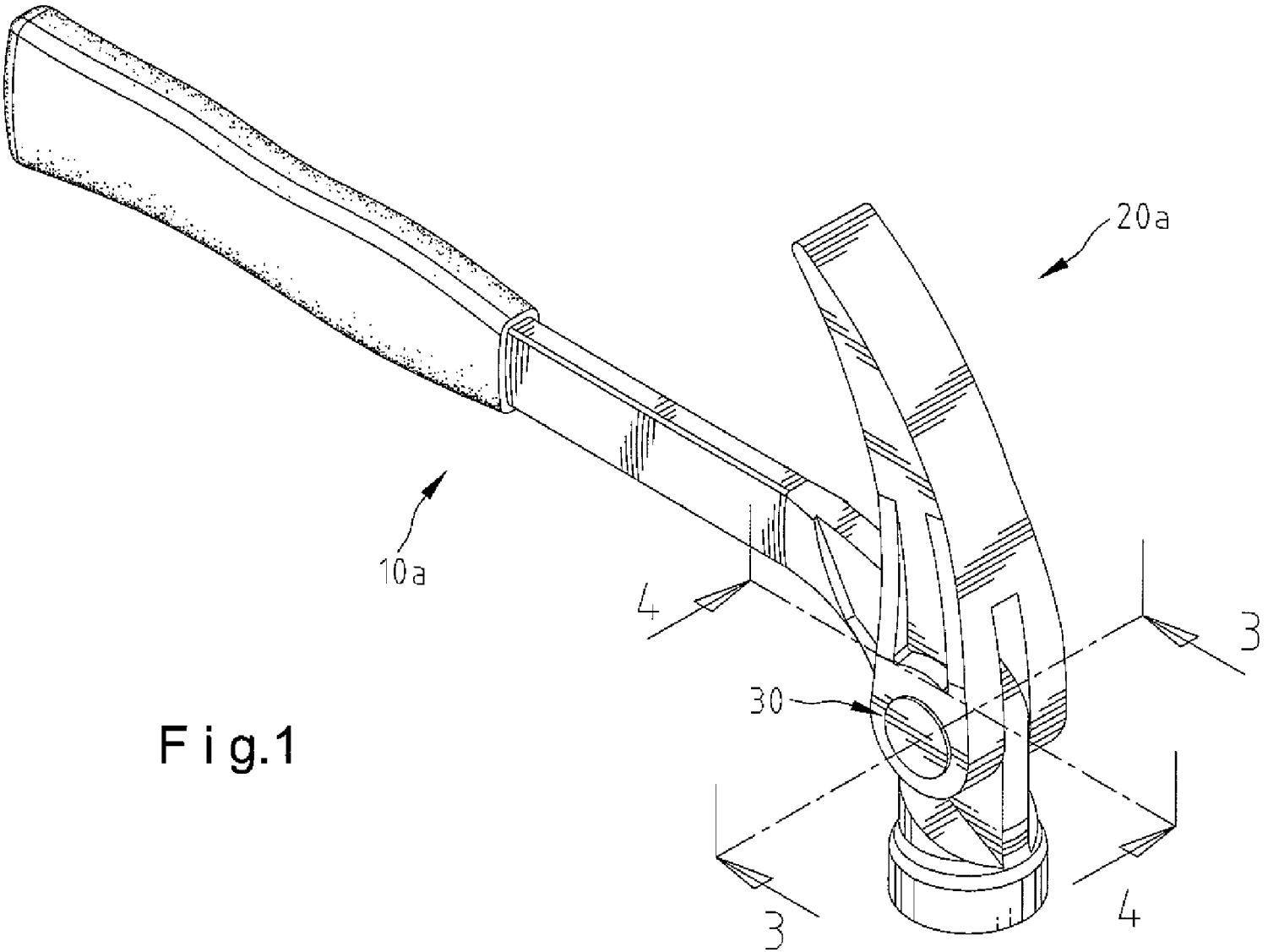
FIG. 1 is a perspective view of a tool in accordance with the first embodiment of the present invention.
Figure 2:
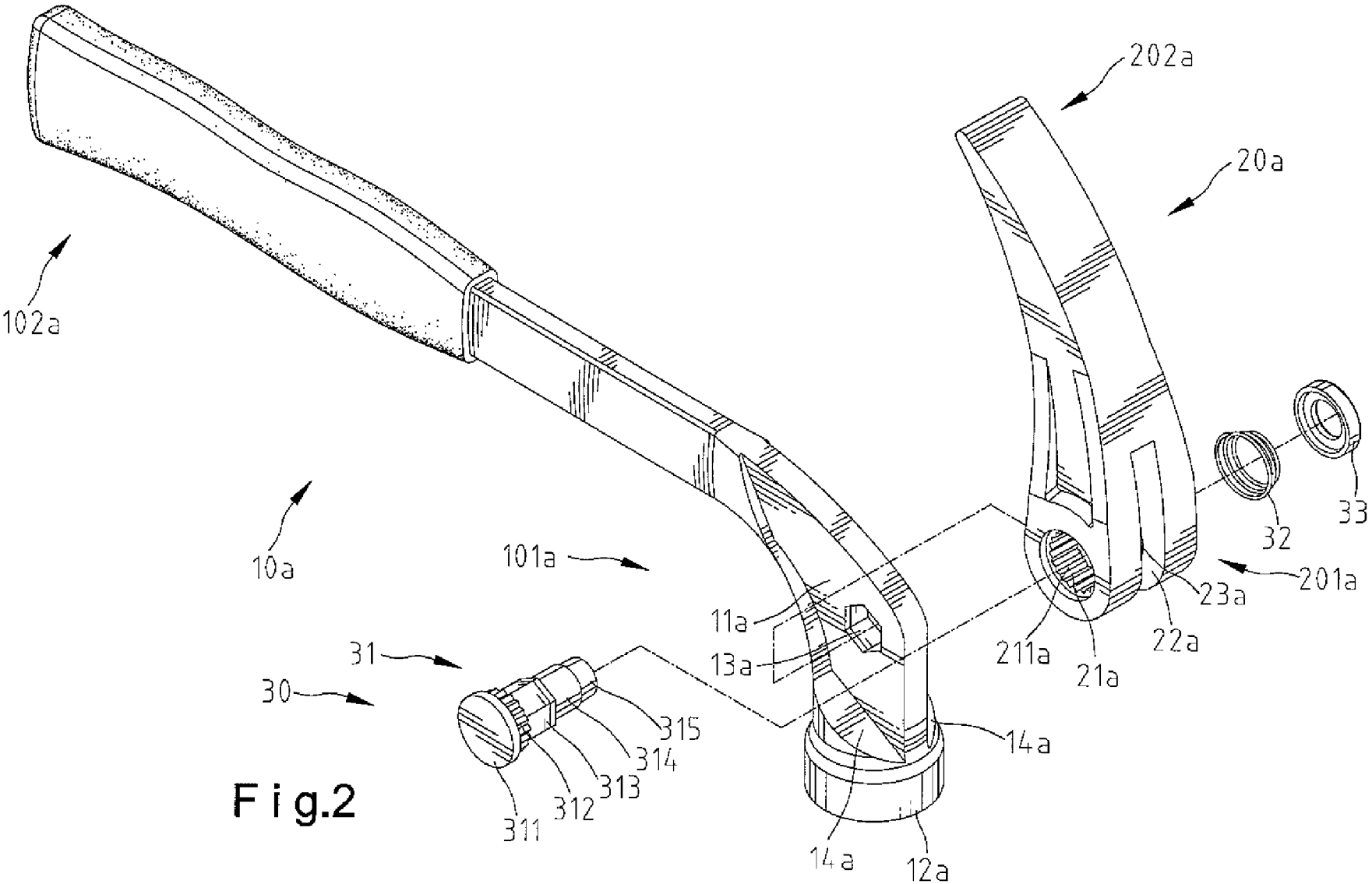
FIG. 2 is an exploded perspective view of the tool shown in FIG. 1.
Figure 3:
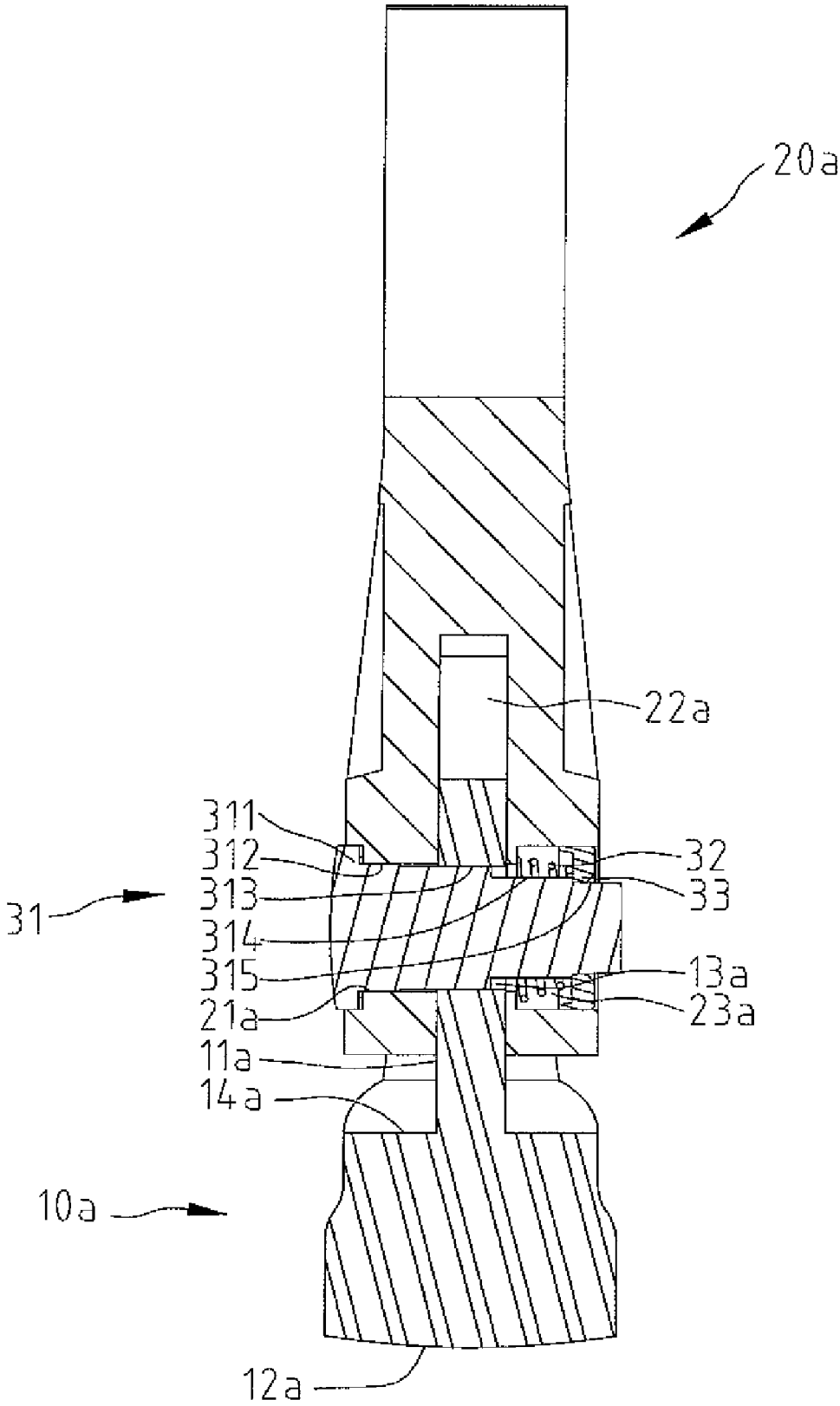
FIG. 3 is a cross-sectional view taken along line 3-3 of FIG. 1.
Figure 4:
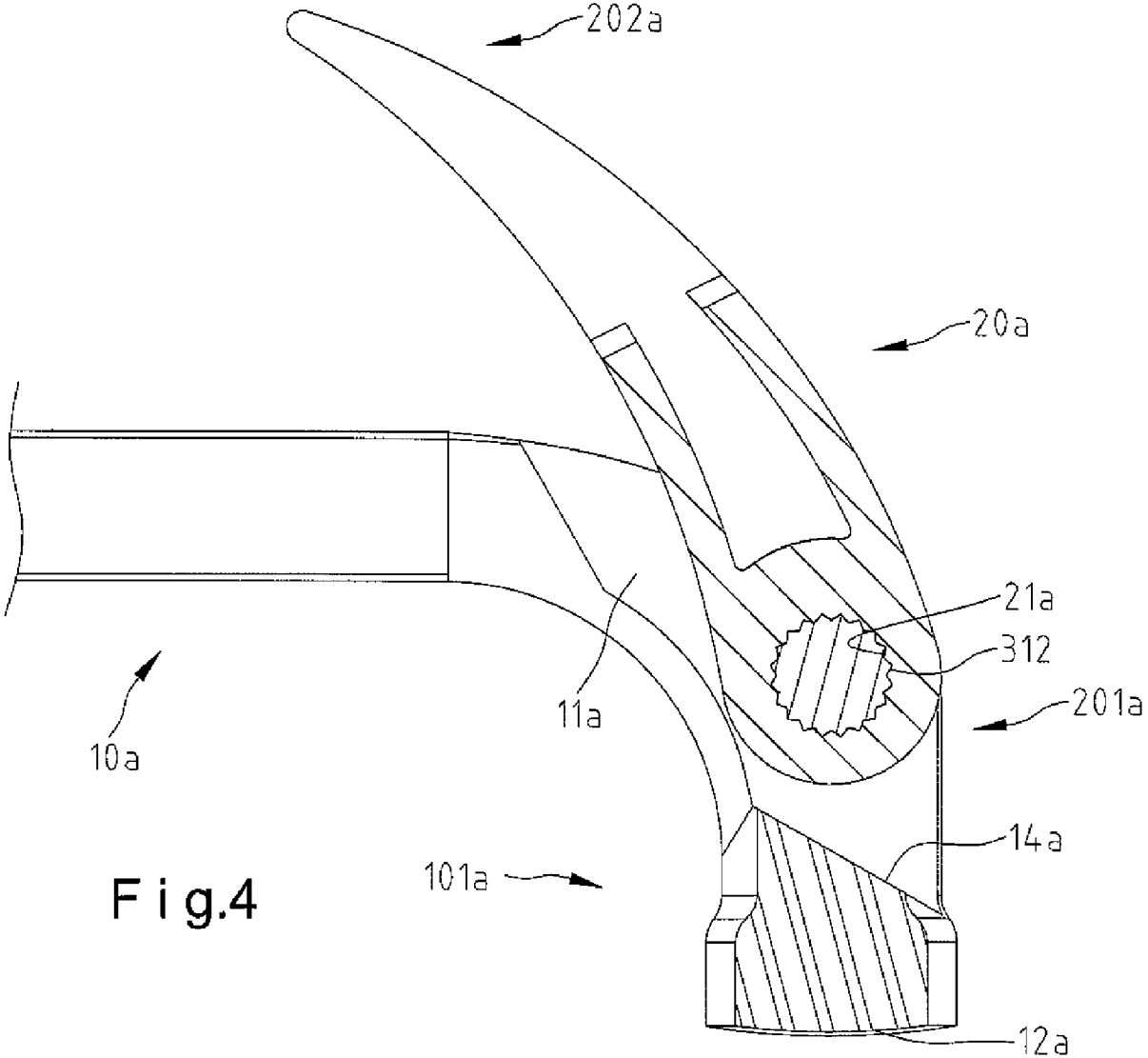
FIG. 4 is a cross-sectional view taken along line 4-4 of FIG. 1.
Figure 5:
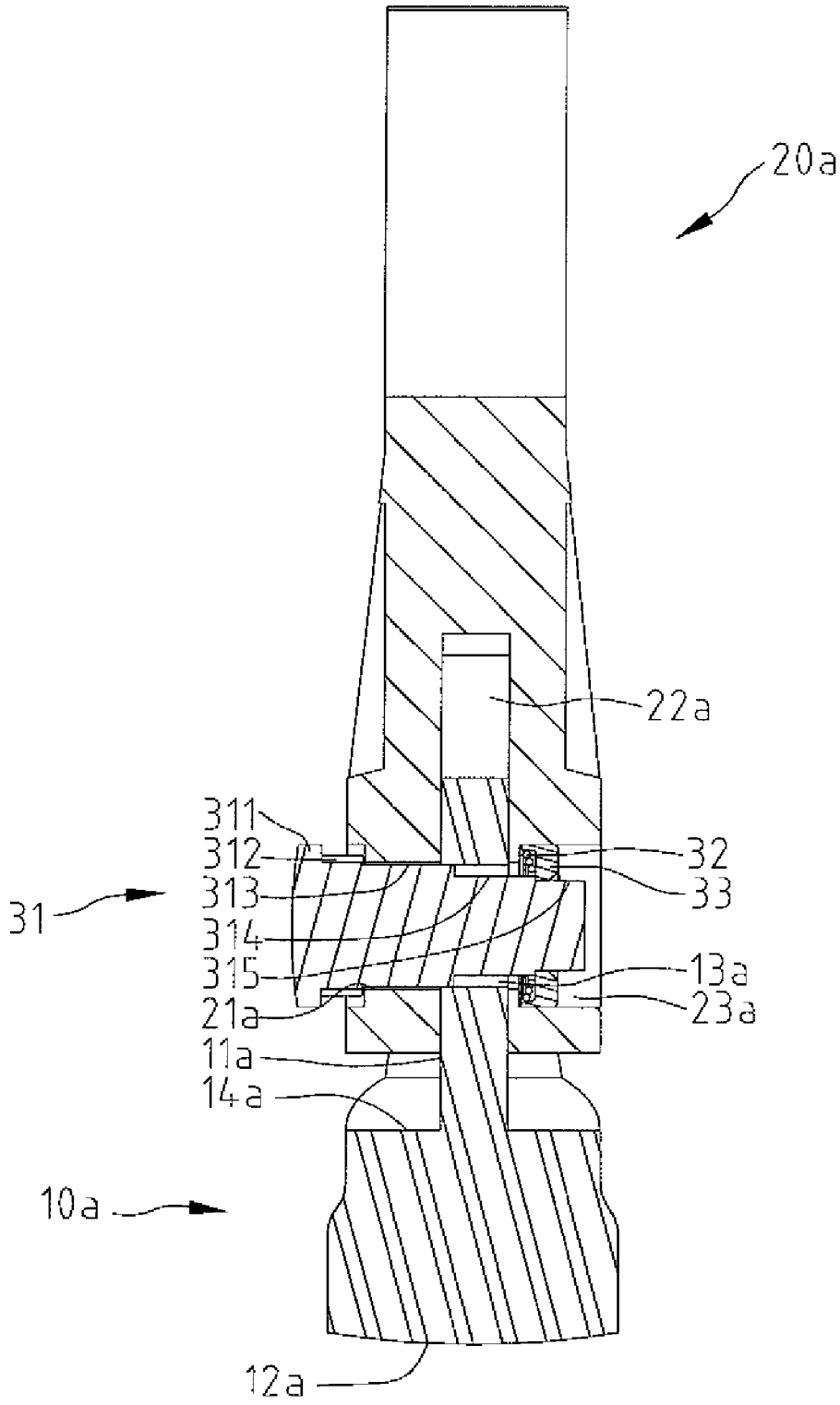
FIG. 5 is another cross-sectional view similar to FIG. 3.
Figure 6:
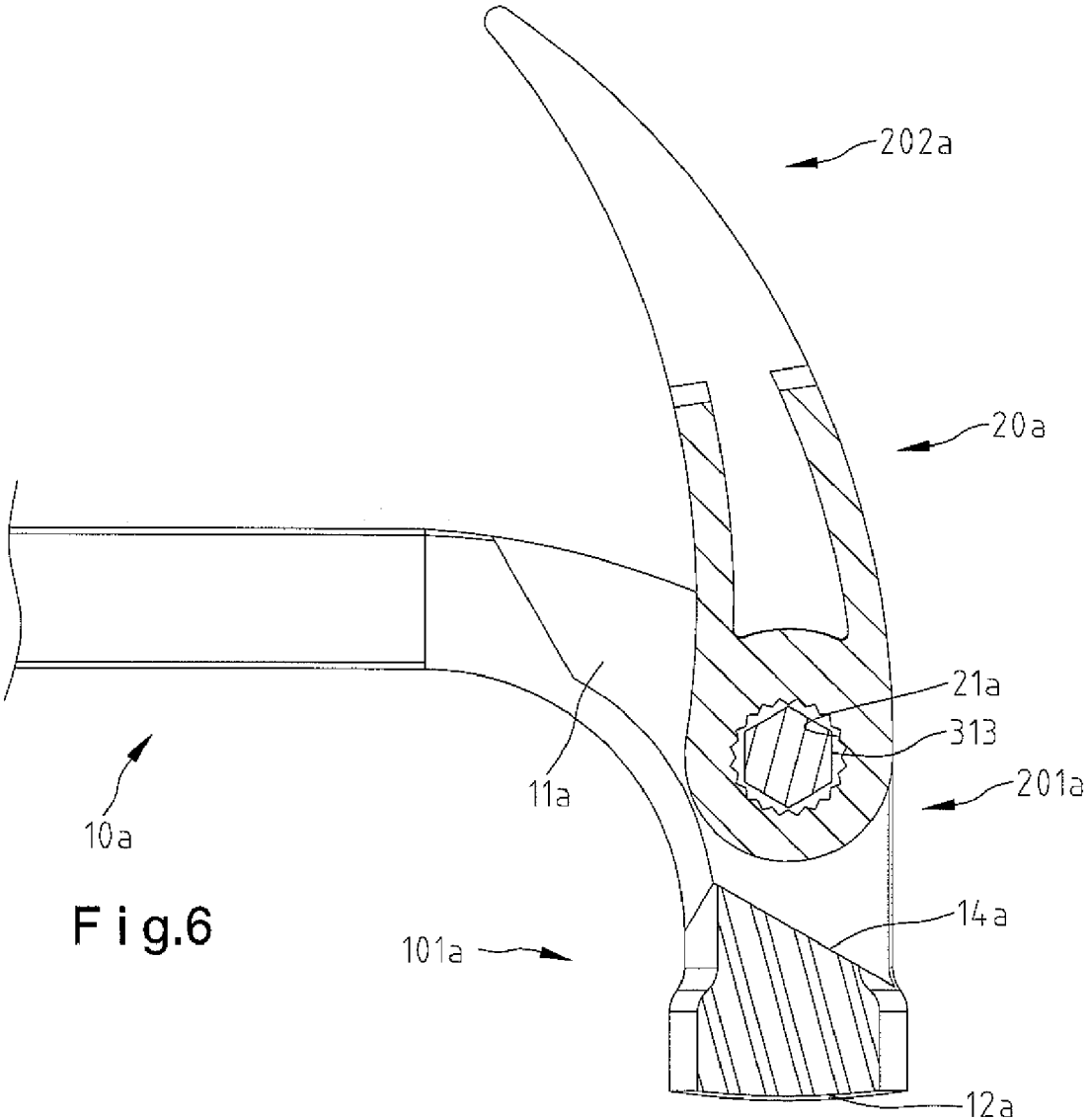
FIG. 6 is another cross-sectional view similar to FIG. 4.

FIGS. 1 through 7 show a tool usable for prying in accordance with a first embodiment of the present invention. The tool includes a handle 10*a*, working device 20*a* and a positioning device 30 which is moveable between a fixing position and an adjusting position. While the positioning device 30 is in the fixing position, the handle 10*a* is fixed in position with respect to the working device 20*a*. While the positioning device 30 is in the adjusting position, the handle 10*a* is able to pivot with respect to the working device 20*a*.

The handle 10*a* includes a pivotal end 101*a* and a grip end 102*a*. A flat coupled portion 11*a* is defined at the pivotal end 101*a*, and a hammering portion 12*a* extends from the distal portion of the pivotal end 101*a* and is treated as a hammer. The coupled portion 11*a* includes a hexagonal through-hole 13*a* transversely formed thereon and two limited portions 14*a* formed on two sides thereof and proximal to the hammering portion 12*a*.

The working device 20*a* includes first and second ends 201*a*, 202*a*. The second end 202*a* is in the form of a pry. A positioned hole 21*a*, a slot 22*a* and a cavity 23*a* are formed at the first end 201*a* and communicate with one another in sequence. The slot 22*a*, which is sandwiched between the positioned hole 21*a* and the cavity 23*a* and extends from the first end 201*a* to the second end 202*a*, is mounted on the pivotal end 101*a* of the handle 10*a*. The positioned hole 21*a* corresponds to the through-hole 13*a* and has a plurality of positioning sections 211*a* defined on the periphery thereof to form the positioned hole 21*a* to be a ratchet hole preferably. In this case, the cavity 23*a* is in the form of a circle hole. Moreover, in other embodiments, attachment of the handle 10*a* and the working device 20*a* can be achieved via the coupled portion 11*a* mounted on the first end 201*a* of the working device 20*a*.

The positioning device 30 is disposed at the through-hole 13*a*, the positioned hole 21*a* and the cavity 23*a* and consists of a controller 31, a resilient member 32 and a retaining member 33. The controller 31 includes a cap 311, a plurality of detents 312, first and second body sections 313, 314 and a joint 315. The controller 31 is inserted through the pivotal end 101*a* and adapted to connect the working device 20*a* to the handle 10*a*. The cap 311 is exposed from the positioned hole 21*a*, and the plurality of detents 312 are removably meshed with the plurality of positioning sections 211*a*. The first body section 313 is adjacent to the cap 311 and has a hexagonal cross-section to correspond to and engage with the trough-hole 13*a*. The second body section 314 is adjacent to the joint 315 and inserted through the resilient member 32 in the cavity 23*a*. The joint 315 is attached to the retaining member 33 in an adhesive manner or a screw manner for preventing removal of the controller 31 from the working device 20*a*.

While the positioning device 30 is in the fixing position, the detents 312 are engaged with the positioning sections 211*a* of the working device 20*a*. Thus, the handle 10*a* is fixed with respect to the working device 20*a*. The profile of the first body section 313 corresponds to that of the through-hole 13*a*, so that the controller 31 cannot rotate with respect to the handle 10*a*. The resilient member 32 and the retaining member 33 are limited in the cavity 23*a*, and the positioning device 30 is restricted at the handle 10*a* and working device 20*a* via the cap 311 and the retaining member 33.

While the positioning device 30 is in the adjusting position, the handle 10*a* is able to rotate with respect to the working device 20*a*. Users push the retaining member 33 of the positioning device 30 to press the resilient member 32 and to further press the controller 31. Then, the detents 312 are disengaged from the positioning sections 211*a* of the positioned hole 21*a*. Therefore, users can adjust the working device 20*a* to a desired angle with respect to the handle 10*a*. After adjustment, the retaining member 33 is released to return the positioning device 30 to be in the fixing position.

Figure 7:
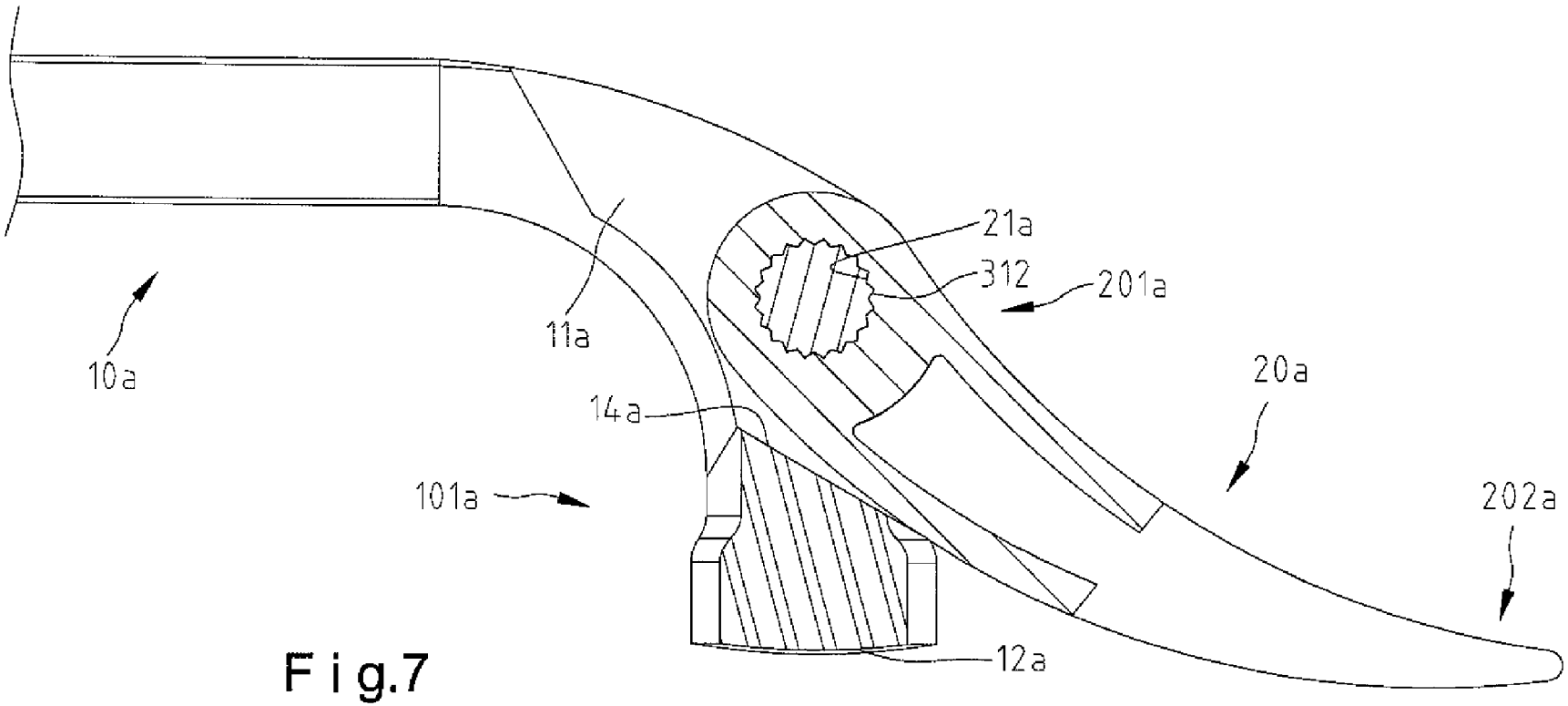
FIG. 7 is a side view of the tool shown in FIG. 1.

The limited portions 14*a* are adapted to restrict rotation of the working device 20*a* with respect to the handle 10*a*. As shown in FIG. 7, the limited portions 14*a* prevent the working device 20*a* from rotating over the hammering portion 12*a*. Further, while the working device 20*a* is used to extract an element to be pried, the limited portions 14*a* provide a support force to the working device 20*a* and prevent the working device 20*a* detaching from the handle 10*a*.

Figure 8:
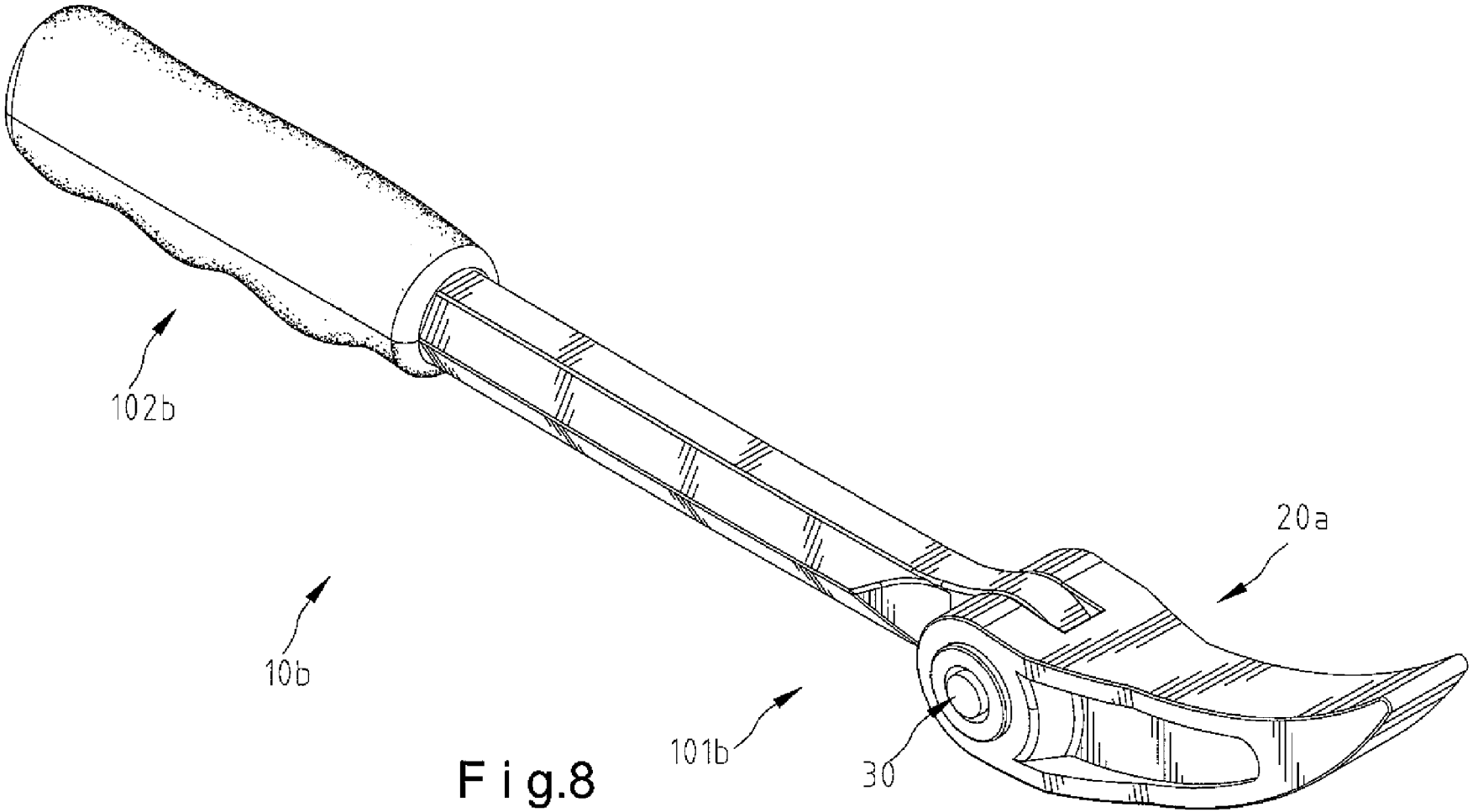
FIG. 8 is a perspective view of a tool in accordance with the second embodiment of the present invention.
Figure 9:
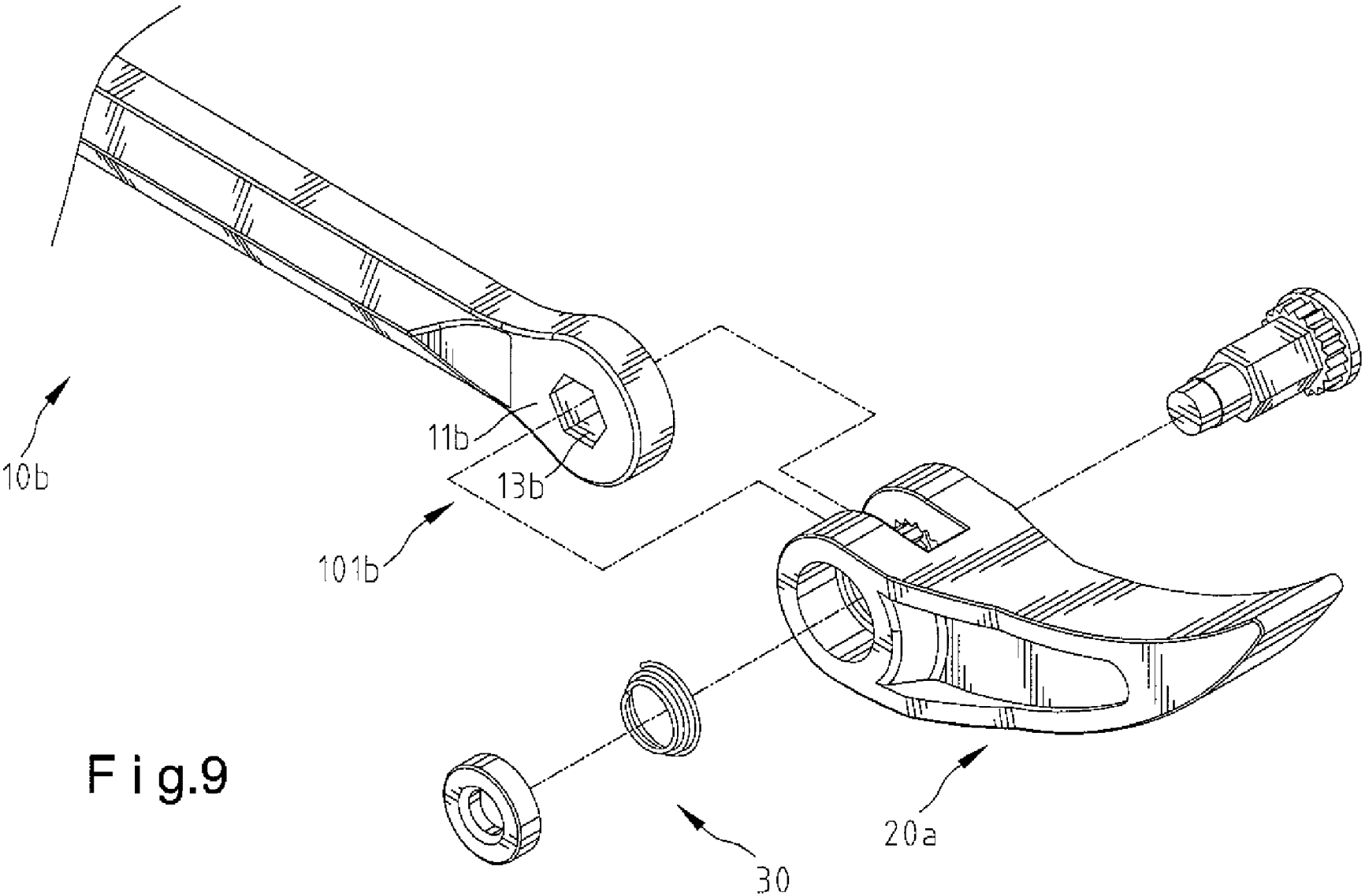
FIG. 9 is an exploded perspective view of the tool shown in FIG. 8.
Figure 10:
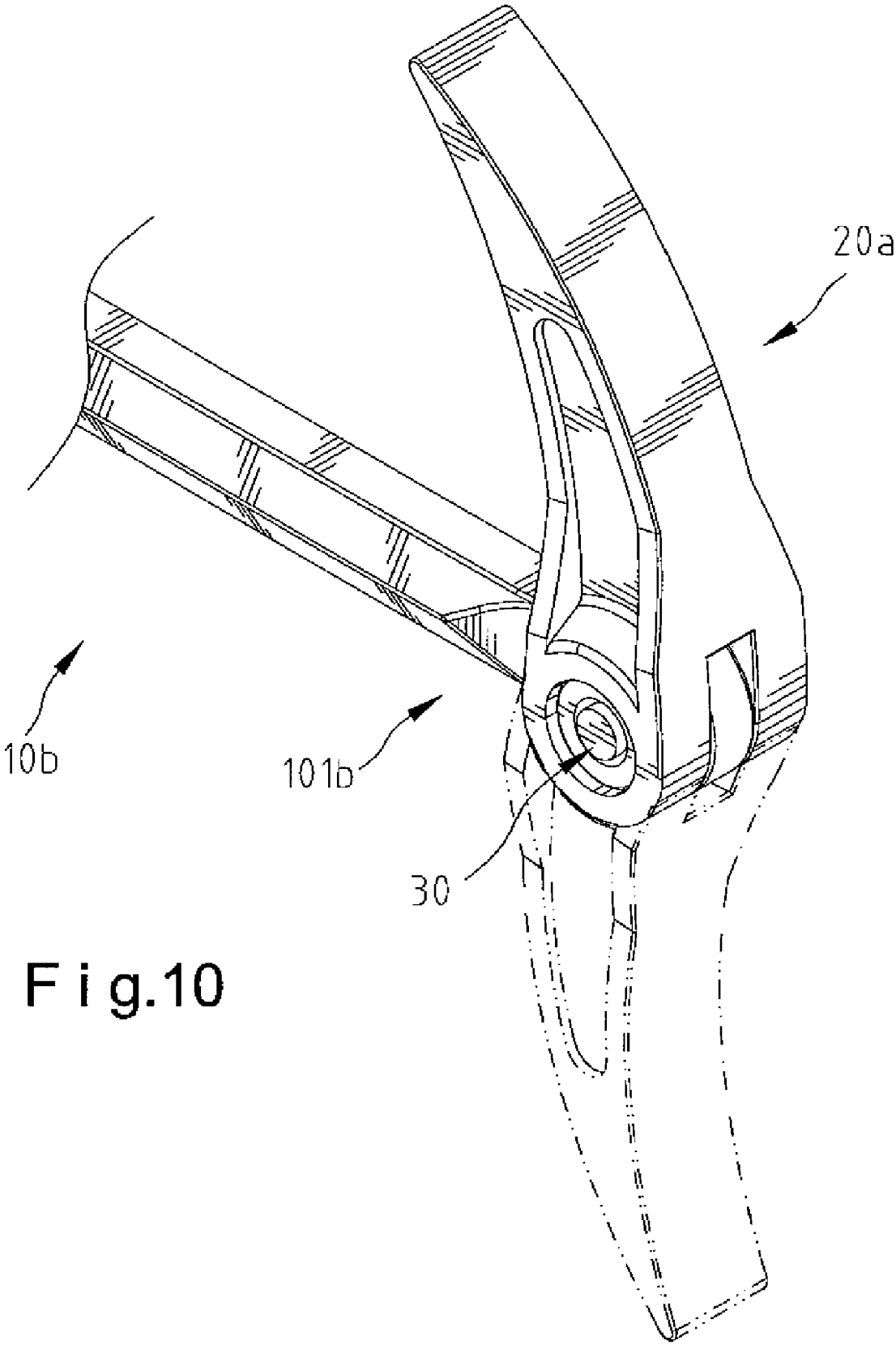
FIG. 10 is another perspective view of the tool shown in FIG. 8.
Figure 11:
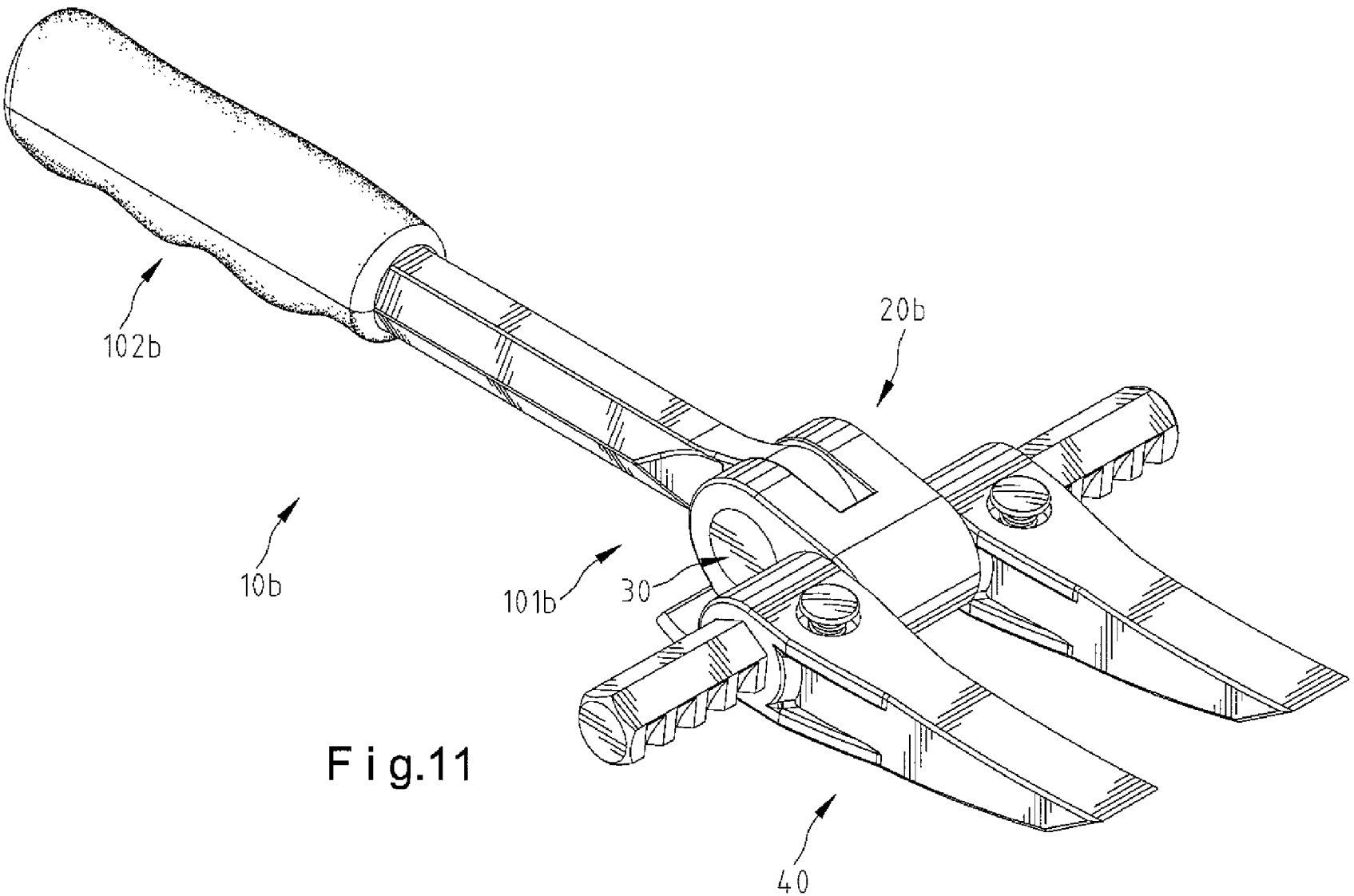
FIG. 11 is a perspective view of a tool in accordance with the third embodiment of the present invention.
Figure 12:
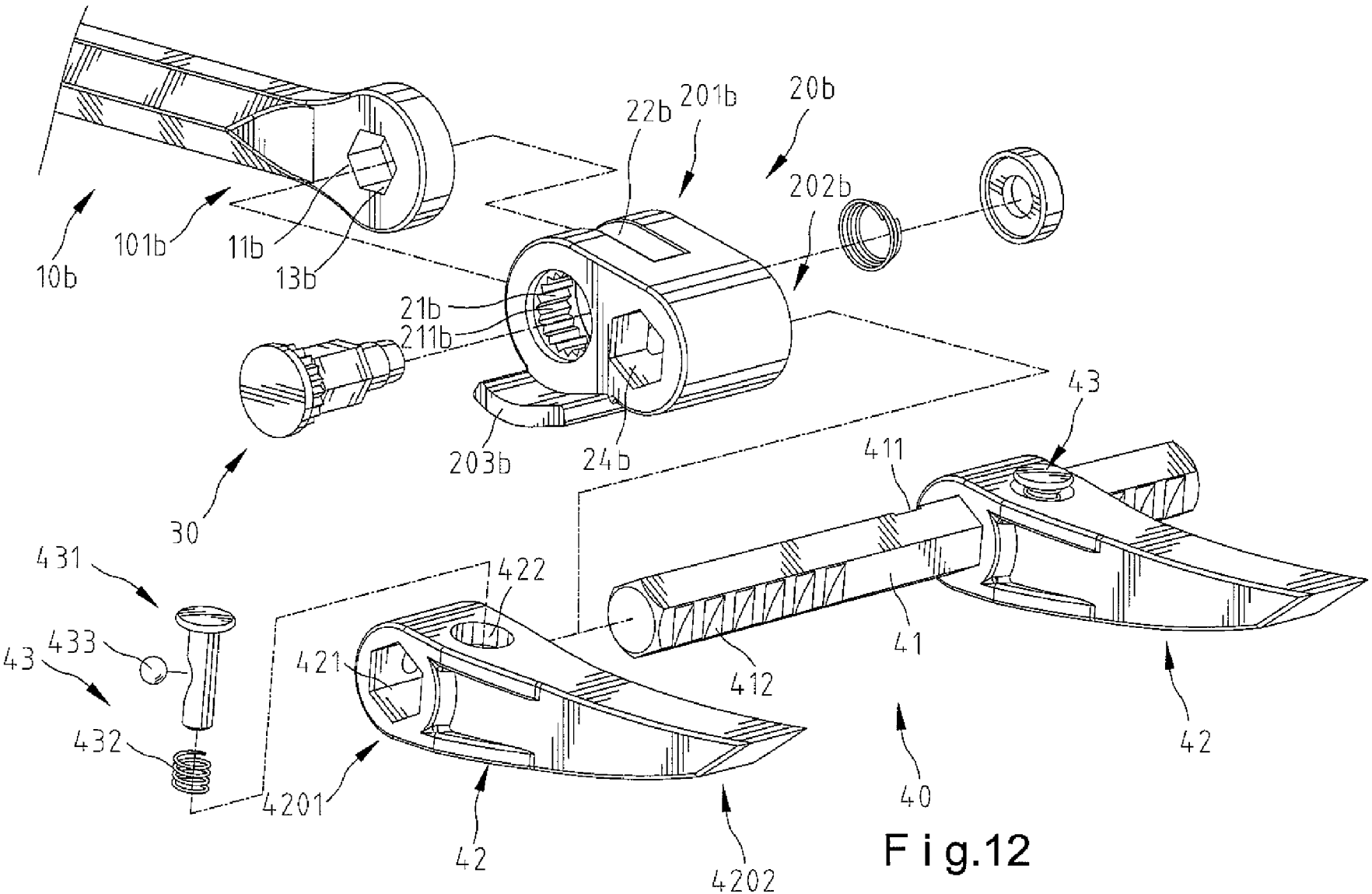
FIG. 12 is an exploded perspective view of the tool shown in FIG. 11.
Figure 13:
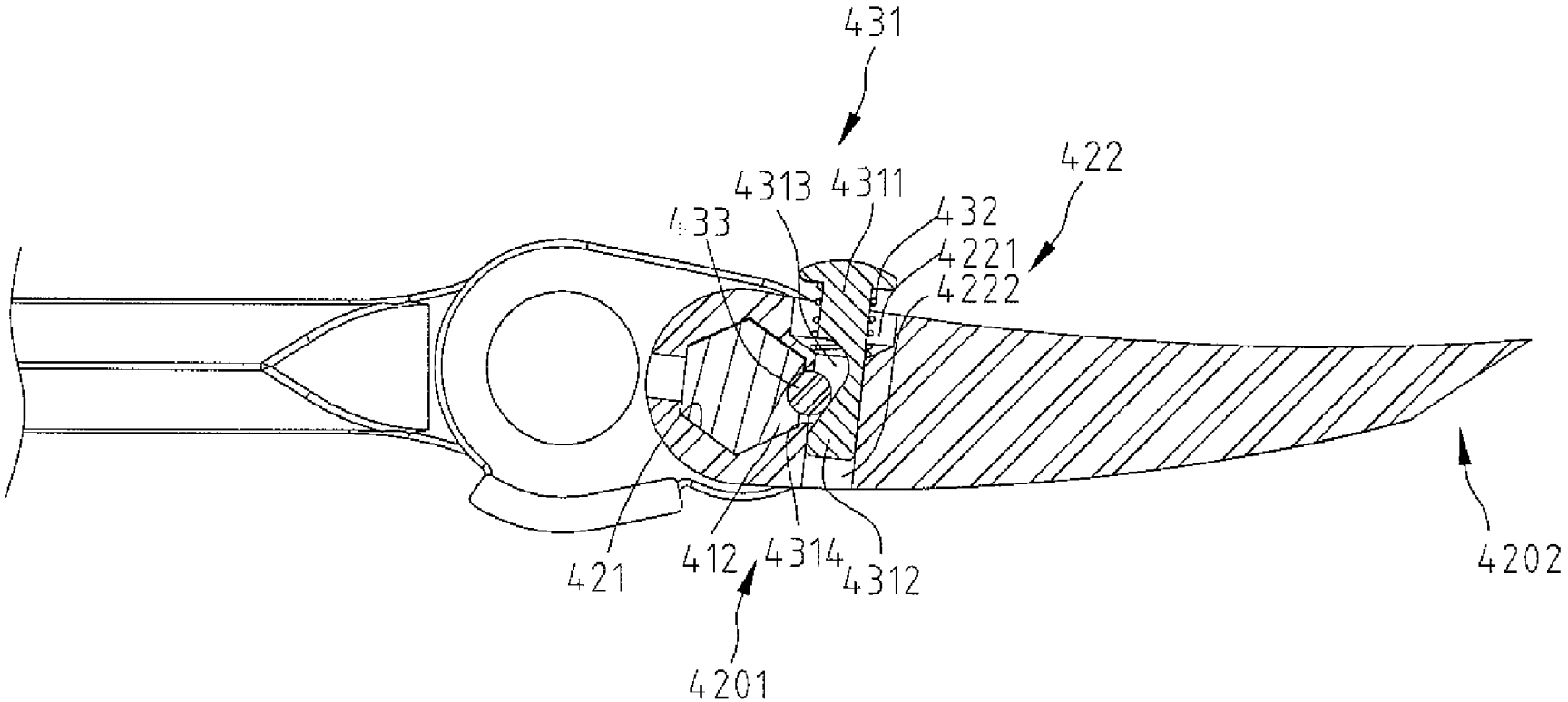
FIG. 13 is a partial, cross-sectional view of the tool shown in FIG. 11.
Figure 14:
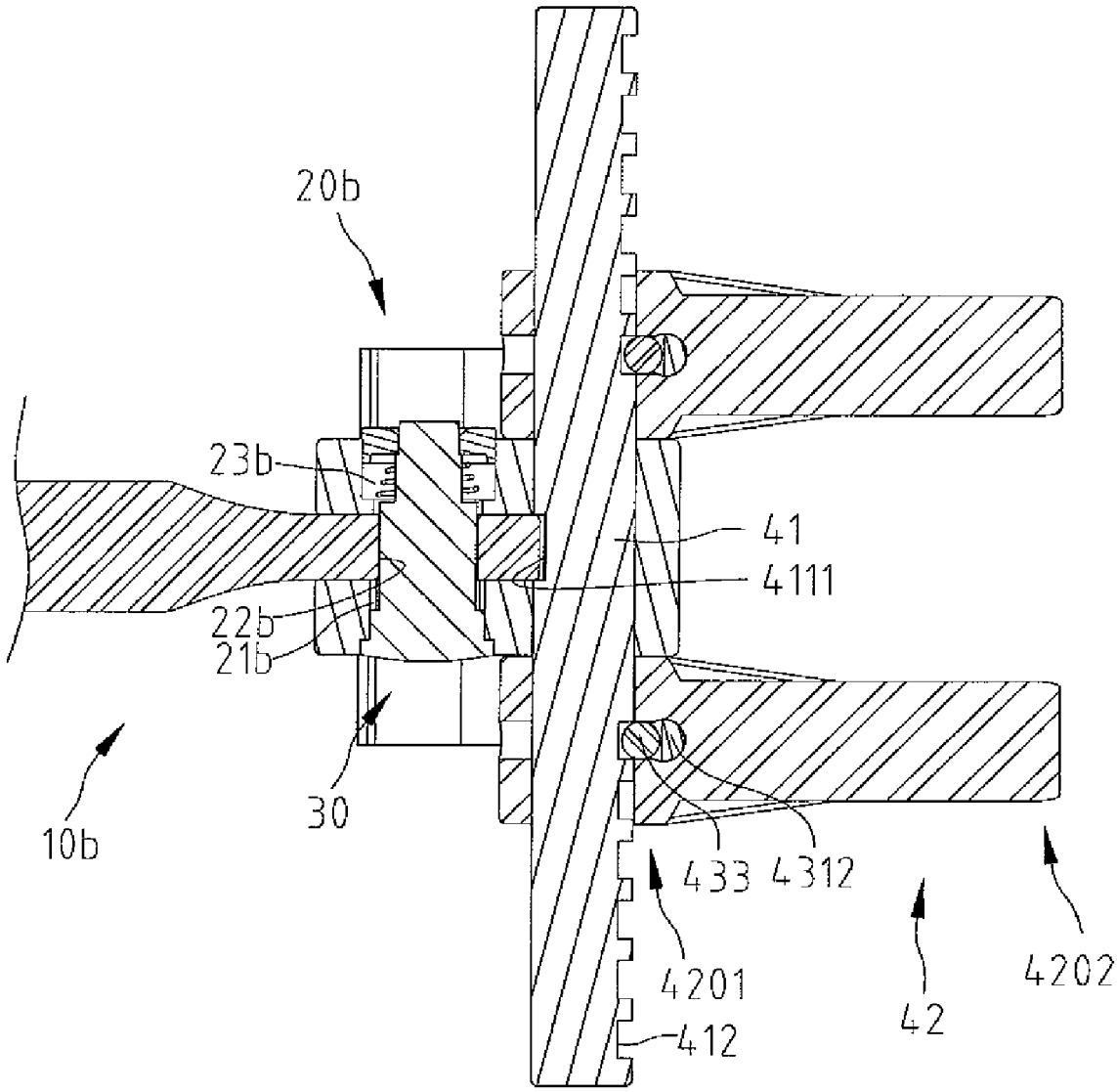
FIG. 14 is another partial, cross-sectional view of the tool shown in FIG. 11.
Figure 15:
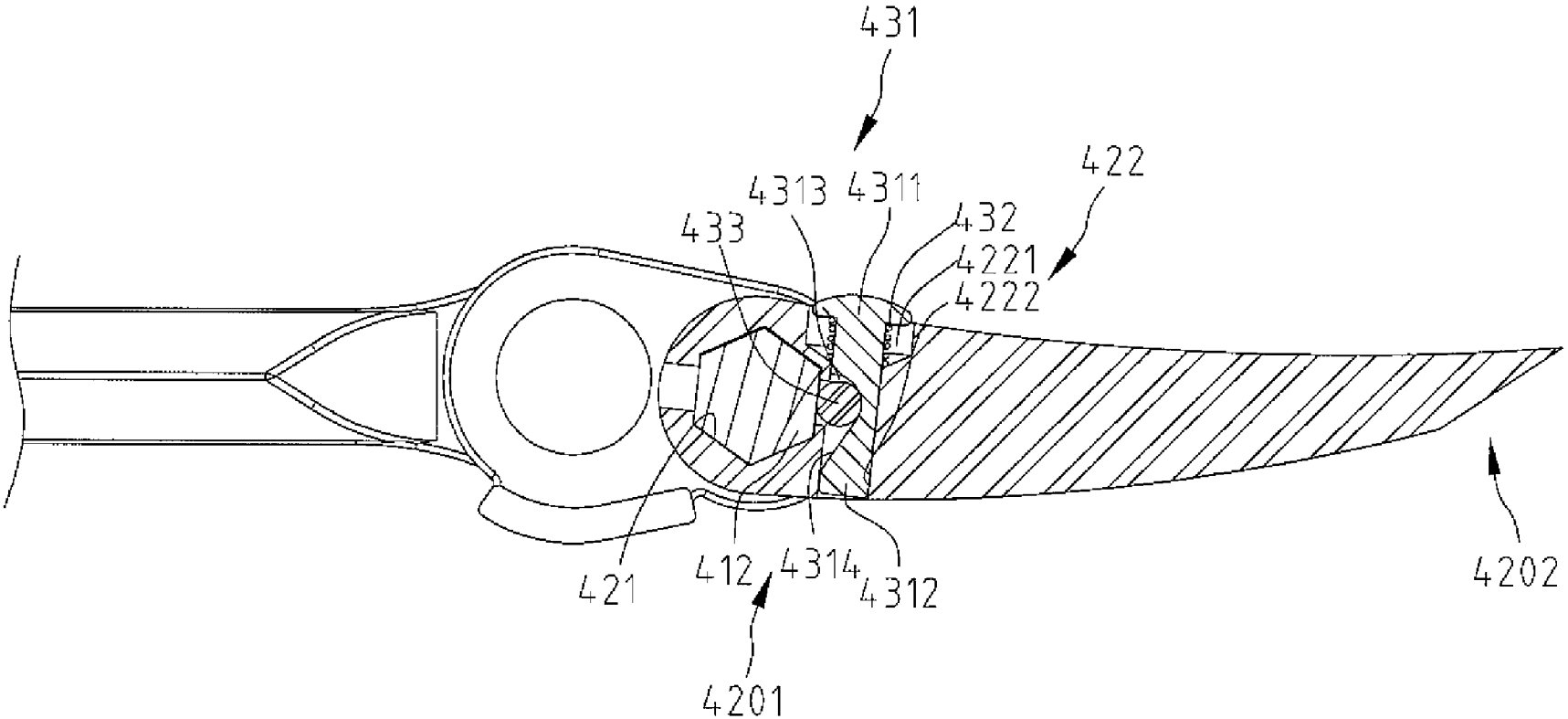
FIG. 15 is another partial, cross-sectional view of the tool similar to FIG. 13.

FIGS. 8 through 10 show a tool usable for prying in accordance with a second embodiment of the present invention and similar to the first embodiment except that a handle 10*b* replaces the handle 10*a*. The handle 10*b* includes a pivotal end 101*b* and a grip end 102*b*. A flat coupled portion 11*b* is defined at the pivotal end 101*b*, and a hexagonal through-hole 13*b* is transversely formed on the coupled portion 11*b* and corresponds to the positioned hole 21*a*. The positioning device 30 is disposed at the through-hole 13*b*.

FIGS. 11 through 16 show a tool is usable for prying in accordance with a third embodiment of the present invention and similar to the second embodiment except that a working device 20*b* replaces the working device 20*a* and that a prying device 40 is further attached to the working device 20*b* for extracting an element to be pried. The working device 20*b* has first and second ends 201*b*, 202*b* and a pressed portion 203*b* formed on the outer periphery thereof between the first and second ends 201*b*, 202*b*. The prying device 40 is coupled to the second end 202*b*. A positioned hole 21*b*, a slot 22*b* and a cavity 23*b* are formed at the first end 201*b* and communicate with one another in sequence. The slot 22*b*, which is sandwiched between the positioned hole 21*b* and the cavity 23*b* and extends from the first end 201*b* to the second end 202*b*, is mounted on the pivotal end 101*b* of the handle 10*b*. The positioned hole 21*b* corresponds to the through-hole 13*b* and has a plurality of positioning sections 211*b* defined on the periphery thereof to form the positioned hole 21*b* to be a ratchet hole preferably. In this case, the cavity 23*b* is in the form of a circle hole. A hexagonal coupled hole 24*b* is transversely formed at the second end 202*b* and communicates with the slot 22*b*. The coupled hole 24*b* is spaced from the positioned hole 21*b*.

The prying device 40 consists of a shaft 41 adapted for insertion through the coupled hole 24*b*, two pry elements 42 and two positioning units 43. A notch 411 is formed on the outer periphery of the center of the shaft 41. A plurality of positioning sections 412 is respectively provided on the outer periphery of two ends of the shaft 41 in a transverse line arrangement.

Each pry element 42 has first and second ends 4201, 4202. First and second connected holes 421, 422 are formed on the first end 4201 and communicate with each other. The first connected hole 421 is preferably a polygon hole and is perpendicular to the second connected hole 422. The second hole 422 has first and second sections 4221, 4222, and a diameter of the first section 4221 is larger than that of the second section 4222. The second end 4202 is treated as a pry.

Each positioning unit 43 is adapted to removably fix the related pry element 42 to the related end of the shaft 41 and consists of a control member 431, a resilient member 432 and a detent 433. The control member 431 is inserted into the second connected hole 422 and has a head 4311 and a body 4312. A recess 4313 and an abutting section 4314 are formed on the body 4312. The resilient member 432 is mounted on the body 4312 and restricted at the first section 4221 of the second connected hole 422. The detent 433 is restricted between the recess 4313 and the abutting section 4314 and positioned at the second section 4222 of the second connected hole 422. The detent 433 is moveable between the selected one positioning section 412 and the recess 4313 and selectively engaged with the selected one positioning section 412 or the recess 4313 to fix the pry elements 42 to the shaft 41 or not. While the detent 433 is in a first position and engaged with the selected one positioning section 412 and against the abutting section 4314, it prevents the pry elements 42 from rotating with respect to the shaft 41. While the detent 433 is driven to be in a second position by pressing the head 4311 of the control member 431, the resilient member 432 is pressed via the control member 431, and the detent 433 is disengaged from the abutting section 4314 and the selected one positioning section 412. Then, the detent 433 is engaged with the recess 4313, so that the pry elements 42 are moveable with respect to the shaft 41.

Moreover, the distal portion of the pivotal end 101*b* is inserted into the notch 411 on the center of the shaft 41. Therefore, the handle 10*b* can be aligned with the center of the shaft 41.

Figure 16:
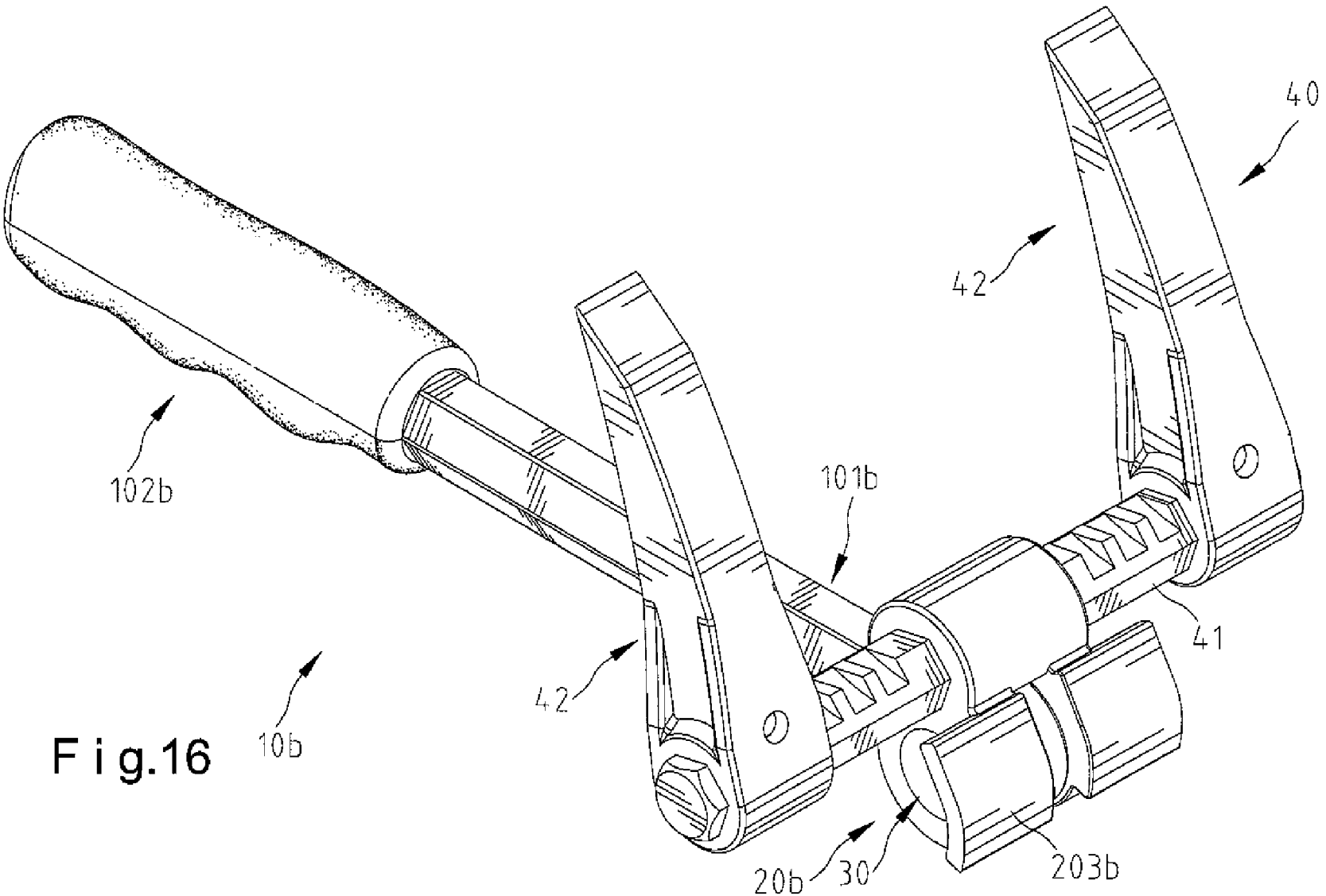
FIG. 16 is another perspective view of the tool shown in FIG. 11.

To operate the positioning device 30 (as shown in FIG. 16), the working device 20*b* is able to rotate with respect to the handle 10*b* till the pressed portion 203*b* is driven to be positioned opposite to the handle 10*b* with respect to the shaft 41, so that the pressed portion 203*b* can be adapted to be used for abutting with the ground or any item.

While the specific embodiments have been illustrated and described, numerous modifications come to mind without significantly departing from the spirit of invention, and the scope of invention is only limited by the scope of accompanying claims.

What is claimed is:

1. A tool adapted for prying comprising:

a handle including a pivotal end and a grip end, with the pivotal end having a through-hole;

a working device having first and second ends, with the first end of the working device pivotally connected to the pivotal end of the handle and including a positioned hole formed transversely and a cavity formed longitudinally and communicating with the positioned hole, with the positioned hole corresponding to the through-hole; and a positioning device disposed at the through-hole, the positioned hole and the cavity and moveable between a fixing position and an adjusting position;

wherein while the positioning device is in the fixing position, the handle is fixed in position with respect to the working device; wherein while the positioning device is in the adjusting position, the handle is able to pivot with respect to the working device, wherein the positioning device further comprises a plurality of detents and a first body section corresponding to and engaging with the trough-hole of the handle; and wherein the positioned hole includes a plurality of positioning sections defined on the periphery thereof, with the plurality of detents removably meshed with the plurality of positioning sections.

2. A tool as claimed in claim 1 wherein the positioning device consists of a controller, a resilient member and a retaining member, with the plurality of detents and the first body section located at the controller, with the resilient and retaining members disposed in the cavity, with the controller inserted through the resilient member and coupled to the retaining member.

3. A tool adapted for prying comprising:

a handle including a pivotal end and a grip end, with the pivotal end having a through-hole;

a working device having first and second ends, with the first end of the working device pivotally connected to the pivotal end of the handle and including a positioned hole formed transversely and a cavity formed longitudinally and communicating with the positioned hole, with the positioned hole corresponding to the through-hole;

a positioning device disposed at the through-hole, the positioned hole and the cavity and moveable between a fixing position and an adjusting position;

wherein while the positioning device is in the fixing position, the handle is fixed in position with respect to the working device; wherein while the positioning device is in the adjusting position, the handle is able to pivot with respect to the working device; and a coupled portion defined at the pivotal end and inserted into a slot defined at the working device, with the slot sandwiched between the positioned hole and the cavity and extending from the first end to the second end of the working device.

4. A tool as claimed in claim 3 further comprising a hammering portion extending from a distal portion of the pivotal end and treated as a hammer.

5. A tool as claimed in claim 4 further comprising two limited portions formed on two sides of the coupled portion and proximal to the hammering portion.

6. A tool adapted for prying comprising:

a handle including a pivotal end and a grip end, with the pivotal end having a through-hole;

a working device having first and second ends, with the first end of the working device pivotally connected to the pivotal end of the handle and including a positioned hole formed transversely and a cavity formed longitudinally and communicating with the positioned hole, with the positioned hole corresponding to the through-hole;

a positioning device disposed at the through-hole, the positioned hole and the cavity and moveable between a fixing position and an adjusting position;

wherein while the positioning device is in the fixing position, the handle is fixed in position with respect to the working device; wherein while the positioning device is in the adjusting position, the handle is able to pivot with respect to the working device; and a prying device attached to the second end of the working device for extracting an element to be pried.

7. A tool as claimed in claim 6 further comprising a pressed portion formed on the outer periphery of the working device between the first and second ends.

8. A tool as claimed in claim 6 wherein the prying device comprises a shaft, two pry elements moveably disposed at two ends of the shaft and two positioning units, with each positioning unit adapted to removably fix the related pry element to the related end of the shaft.

9. A tool as claimed in claim 8 further comprising a plurality of positioning sections respectively provided on the outer periphery of two ends of the shaft in a transverse line arrangement and first and second connected holes formed on each pry element and communicating with each other, with the shaft inserted into the first connected hole, with the plurality of positioning units disposed in the second connected holes and selectively engaged with the selected one positioning section.

10. A tool as claimed in claim 9 wherein each positioning units consists of a control member, a resilient member and a detent, with the control member inserted into the second connected hole, with the detent moveable between the selected one positioning section and a recess formed on the control member and selectively engaged with the selected one positioning section or the recess.

11. A tool as claimed in claim 10 wherein the control member has a head and a body, with the recess and an abutting section formed on the body; and wherein the detent is restricted between the recess and the abutting section and positioned at the second connected hole.

12. A tool as claimed in claim 11 wherein the second hole of each pry element has first and second sections, and wherein a diameter of the first section is larger than that of the second section.

13. A tool as claimed in claim 12 wherein the resilient member is mounted on the body and restricted at the first section of the second connected hole.

14. A tool as claimed in claim 2, with the through-hole being hexagonal, and with the first body section having a hexagonal cross-section to correspond to and engage with the trough-hole.

15. A tool as claimed in claim 2 wherein the controller further includes a cap, a second body section and a joint, with the cap exposed from the positioned hole and being opposite to the joint, with the first body section adjacent to the cap, with the second body section adjacent to the joint and inserted through the resilient member in the cavity, and with the joint attached to the retaining member.

16. A tool as claimed in claim 8 further comprising a coupled hole transversely formed at the second end and communicating with the slot; wherein the coupled hole is spaced from the positioned hole and inserted by the shaft of the prying device.

* * * * *